US012805569B2

(12) United States Patent
Taurino et al.

(10) Patent No.: US 12,805,569 B2
(45) Date of Patent: Nov. 24, 2026

(54) CARTRIDGE FOR USE IN AN AEROSOL-GENERATING SYSTEM AND AN AEROSOL-GENERATING SYSTEM COMPRISING SAID CARTRIDGE

(71) Applicant: Philip Morris PRoducts S.A., Neuchatel (CH)

(72) Inventors: Irene Taurino, Neuchatel (CH); Ihar Nikolaevich Zinovik, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 439 days.

(21) Appl. No.: 17/758,681

(22) PCT Filed: Jan. 27, 2021

(86) PCT No.: PCT/EP2021/051833
§ 371 (c)(1),
(2) Date: Jul. 12, 2022

(87) PCT Pub. No.: WO2021/151927
PCT Pub. Date: Aug. 5, 2021

(65) Prior Publication Data

US 2023/0046602 A1 Feb. 16, 2023

(30) Foreign Application Priority Data

Jan. 28, 2020 (EP) ..... 20154181

(51) Int. Cl.
*A24F 40/465* (2020.01)
*A24F 40/42* (2020.01)
(Continued)

(52) U.S. Cl.
CPC ..... *A24F 40/465* (2020.01); *A24F 40/42* (2020.01); *A24F 40/44* (2020.01); *A24F 40/51* (2020.01)

(58) Field of Classification Search
None
See application file for complete search history.

(56) References Cited

U.S. PATENT DOCUMENTS

2009/0293888 A1* 12/2009 Williams ..... A24F 40/42 131/178
2015/0090280 A1 4/2015 Chen
(Continued)

FOREIGN PATENT DOCUMENTS

CN 103960782 A 8/2014
CN 107889450 A 4/2018
(Continued)

OTHER PUBLICATIONS

Machine translation of CN 109414078 A (Year: 2026).*
(Continued)

*Primary Examiner* — Michael H. Wilson
*Assistant Examiner* — Tobey C Le
(74) *Attorney, Agent, or Firm* — Oblon, McClelland, Maier & Neustadt, L.L.P.

(57) ABSTRACT

A cartridge for an aerosol-generating system is provided, the cartridge including: a porous ceramic body having a porosity of between 30% and 65%; and a mesh heater engaged with the porous ceramic body, the mesh heater including a plurality of apertures, each aperture having a dimension between 50 microns and 200 microns, in which the mesh heater is a hybrid mesh heater including a network of wires and fibres, the fibres having a different material composition from the wires. An aerosol-generating system, including an aerosol-generating device and the cartridge, is also provided.

20 Claims, 6 Drawing Sheets

(51) Int. Cl.
*A24F 40/44* (2020.01)
*A24F 40/51* (2020.01)

(56) References Cited

U.S. PATENT DOCUMENTS

| | | | | |
|---|---|---|---|---|
| 2015/0245669 | A1* | 9/2015 | Cadieux | A24F 40/465 131/329 |
| 2015/0320116 | A1 | 11/2015 | Bleloch et al. | |
| 2015/0335073 | A1* | 11/2015 | Li | A24F 40/44 392/395 |
| 2016/0044965 | A1* | 2/2016 | Liu | A24F 40/50 392/394 |
| 2016/0353802 | A1* | 12/2016 | Malgat | A24F 40/42 |
| 2017/0188629 | A1* | 7/2017 | Dickens | A61M 15/06 |
| 2017/0188630 | A1* | 7/2017 | Buchberger | A61M 15/06 |
| 2017/0325505 | A1* | 11/2017 | Force | A61M 15/06 |
| 2018/0064169 | A1 | 3/2018 | Biel et al. | |
| 2018/0295881 | A1 | 10/2018 | Mironov et al. | |
| 2019/0053539 | A1* | 2/2019 | Davis | A24F 40/46 |
| 2019/0166912 | A1* | 6/2019 | Ding | A24F 40/42 |
| 2019/0246692 | A1 | 8/2019 | Li et al. | |
| 2019/0350256 | A1* | 11/2019 | Hejazi | A24F 40/44 |
| 2020/0086067 | A1 | 3/2020 | Li et al. | |

FOREIGN PATENT DOCUMENTS

| | | | | | |
|---|---|---|---|---|---|
| CN | 108968160 | A | | 12/2018 | |
| CN | 109222235 | A | | 1/2019 | |
| CN | 109414078 | A | * | 3/2019 | A24F 40/46 |
| CN | 109688850 | A | | 4/2019 | |
| KR | 20-0400449 | | | 11/2005 | |
| KR | 10-2015-0145263 | A | | 12/2015 | |
| KR | 10-2019-0034198 | A | | 4/2019 | |
| KR | 10-2019-0087313 | A | | 7/2019 | |
| RU | 2 597 540 | C2 | | 9/2016 | |
| RU | 2 692 784 | C2 | | 6/2019 | |
| UA | 67598 | U | | 2/2012 | |
| WO | WO 2015/117704 | A1 | | 8/2015 | |
| WO | WO 2019/157645 | A1 | | 8/2019 | |
| WO | WO 2019/157647 | A1 | | 8/2019 | |
| WO | WO 2019/157648 | A1 | | 8/2019 | |
| WO | WO 2019/157651 | A1 | | 8/2019 | |

OTHER PUBLICATIONS

Extended European Search Report issued on Aug. 25, 2020 in European Patent Application No. 20154181.0, 16 pages.
International Preliminary Report on Patentability and Written Opinion issued on Jul. 28, 2022 in PCT/EP2021/051833 filed on Jan. 27, 2021, 7 pages.
International Search Report mailed on Apr. 26, 2021 in PCT/EP2021/051833 filed on Jan. 27, 2021 (5 pages).
Written Opinion mailed on Apr. 26, 2021 in PCT/EP2021/051833 filed on Jan. 27, 2021 (6 pages).
Combined Russian Office Action and Search Report issued May 6, 2024, in patent application 2022120802/03(043784), (with English language translation of the Office Action only), 9 pages.
Japanese Office Action issued Feb. 17, 2025 in corresponding Japanese Patent Application No. 2022-545812, with English Translation, 5 pages.
Combined Chinese Office Action and Search Report issued on Apr. 23, 2025 in Chinese Patent Application No. 202180011202.4 (with unedited computer-generated English translation), 18 pages.
Office Action dated Sep. 23, 2025 in corresponding South Korean patent application No. 2022-7029129 (with English translation).
Notice of Allowance dated Aug. 11, 2026 issued in the corresponding Ukraine Patent Application No. A202203058 (with English translation) (citing document 1).

* cited by examiner

CARTRIDGE FOR USE IN AN AEROSOL-GENERATING SYSTEM AND AN AEROSOL-GENERATING SYSTEM COMPRISING SAID CARTRIDGE

The invention relates to a cartridge for use in an aerosol-generating system. The invention also relates to an aerosol-generating system comprising said cartridge.

One type of aerosol-generating system is an electrically operated smoking system. Handheld, electrically operated smoking systems consisting of an aerosol-generating device comprising a battery and control electronics, and a cartridge comprising a supply of aerosol-forming substrate and an electrically operated vaporiser, are known. A cartridge comprising both a supply of aerosol-forming substrate and a vaporiser is sometimes referred to as a "cartomiser". The vaporiser typically comprises a coil of heater wire wound around an elongate wick soaked in liquid aerosol-forming substrate. The cartridge portion typically comprises not only the supply of aerosol-forming substrate and an electrically operated vaporiser, but also a mouthpiece, which the user sucks on in use to draw aerosol into their mouth.

However, these cartridges can be relatively expensive to produce. This is because manufacturing the wick and coil assembly can be difficult. Also, the electrical contacts between the coil of heater wire and the electrical contacts through which electrical current is delivered from the device portion must be delicately handled during manufacture. Furthermore, these cartridges include a mouthpiece portion in order to protect the delicate wick and coil assembly during transport. The inclusion of a complete and robust mouthpiece in each cartridge means that each cartridge has a high material cost.

It would be desirable to provide a cartridge for use in an aerosol-generating system which is straightforward and inexpensive to produce and is robust. It would also be desirable to provide a cartridge which can provide more efficient aerosol-generation than known cartridges. It would also be desirable to provide an aerosol-generating system incorporating such a cartridge.

According to the present disclosure, there is provided a cartridge. The cartridge may be suitable for use in an aerosol-generating system. The cartridge may comprise a porous ceramic body. The porous ceramic body may have a porosity of between 30% and 65%. The cartridge may comprise a mesh heater. The mesh heater may be engaged with the porous ceramic body. The mesh heater may include a plurality of apertures. The apertures may each have a dimension between 50 microns and 200 microns.

According to a first embodiment of the present disclosure, there is provided a cartridge for use in an aerosol-generating system. The cartridge comprises a porous ceramic body having a porosity of between 30% and 65%. The cartridge comprises a mesh heater engaged with the porous ceramic body. The mesh heater includes a plurality of apertures, each aperture having a dimension between 50 microns and 200 microns.

According to a second embodiment of the present disclosure, there is provided a cartridge for use in an aerosol-generating system. The cartridge comprises a porous ceramic body and a mesh heater engaged with the porous ceramic body. The mesh heater is a hybrid mesh heater comprising a network of wires and fibres, the fibres having a different material composition to the wires.

In the cartridge of the second embodiment, the porous ceramic body may have a porosity of between 30% and 65%. The mesh heater may include a plurality of apertures. The apertures may each have a dimension between 50 microns and 200 microns.

Features described below in relation to a cartridge are applicable to the cartridge of the first embodiment and the cartridge of the second embodiment.

In use, the mesh heater may heat a liquid aerosol-forming substrate. The mesh heater may heat the liquid aerosol-forming substrate to form an aerosol, or a vapour which subsequently forms an aerosol. Advantageously, the mesh heater may provide efficient aerosol generation.

The porosity of the porous ceramic body may allow the porous ceramic body to hold a liquid aerosol-forming substrate. The porous ceramic body may hold, or may be configured to hold, at least 0.05, 0.1, 0.2, 0.5 or 1 ml of the liquid aerosol-forming substrate.

Each aperture has a dimension between 50 microns and 200 microns. The liquid aerosol-forming substrate may be drawn into the apertures of the mesh heater. The liquid aerosol-forming substrate may be drawn into the apertures of the mesh heater from the porous ceramic body. The liquid aerosol-forming substrate may be drawn into the apertures of the mesh heater by capillary action, or wicking. Advantageously, this may improve transport of liquid aerosol-forming substrate, for example from the porous ceramic body into the apertures of the mesh heater.

The mesh heater may comprise an arrangement of apertures bounded by solid material, for example wires. Each aperture of the mesh heater may act as a capillary channel thus drawing liquid aerosol-forming substrate into the aperture. The liquid aerosol-forming substrate may be drawn into the apertures by capillary action, or wicking. Thus, each aperture of the mesh heater may be substantially fully occupied by the liquid aerosol-forming substrate. This may not be the case if, for example, larger apertures are present. If larger apertures are present, the liquid aerosol-forming substrate may form only a thin layer on the solid material bounding each aperture. The substantially full occupation of the apertures by the liquid aerosol-forming substrate contributes to the improved efficiency of aerosol generation in the present invention.

Advantageously, the inventors have found the porous ceramic body having a porosity between 30% and 65% and the apertures in the mesh heater each having a dimension between 50 microns and 200 microns allows for particularly efficient transport of liquid aerosol-forming substrate through the porous ceramic body and into the apertures of the mesh heater, and particularly efficient aerosol generation upon heating by the mesh heater. Without wishing to be bound by theory, it is thought that there is a degree of synergy between the porous ceramic body having a porosity between 30% and 65% and the apertures in the mesh heater having a dimension between 50 microns and 200 microns which provides such efficient transport of liquid aerosol-forming substrate.

As used herein, the term "aerosol" refers to a dispersion of solid particles, or liquid droplets, or a combination of solid particles and liquid droplets, in a gas. The aerosol may be visible or invisible. The aerosol may include vapours of substances that are ordinarily liquid or solid at room temperature as well as solid particles, or liquid droplets, or a combination of solid particles and liquid droplets.

As used herein, the term "aerosol-forming substrate" refers to a substrate capable of releasing volatile compounds that can form an aerosol. The volatile compounds may be released by heating or combusting the aerosol-forming substrate.

The aerosol-forming substrate may comprise nicotine. The aerosol-forming substrate may comprise plant-based material. The aerosol-forming substrate may comprise homogenised plant-based material. The aerosol-forming substrate may comprise tobacco. The aerosol-forming substrate may comprise a tobacco-containing material. The tobacco-containing material may contain volatile tobacco flavour compounds. These compounds may be released from the aerosol-forming substrate upon heating. The aerosol-forming substrate may comprise homogenised tobacco material. The aerosol-forming substrate may comprise other additives and ingredients, such as flavourants.

As used herein, the term "dimension of an aperture" refers to a dimension measured between two opposing surfaces of an aperture. Thus, where an aperture is bounded by wires, for example, the dimension of the aperture does not include a thickness of the wires. The dimension may pass through the centroid of the cross-section of the aperture. For example, where the aperture has a substantially square cross-section, the dimension of the aperture may be the side-length of the square. Where the aperture has a substantially circular cross-section, the dimension of the aperture may be the diameter of the circle. Where the aperture has a substantially rectangular cross-section, the dimension of the aperture may be the longer side-length, or the shorter side-length, of the rectangle. Where the aperture has an irregular cross-section, the dimension of the aperture may be the average opening dimension. The dimensions of apertures referred to herein have been measured using a microscope, though any suitable method could be used.

As used herein, the term "porosity" refers to a measure, expressed as a percentage, of the volume of the accessible pores, or empty space, of a body divided by the total volume of the body. The porosities referred to herein have been measured by mercury intrusion porosimetry.

Pores of different shapes and sizes may be present in the porous ceramic body. The pore size distribution is defined as the statistical distribution of the diameter of the largest sphere that can fit inside a pore at a given point. As used herein, the term "average pore size" refers to a mean of this pore size distribution. The pore sizes referred to herein have been obtained using mercury intrusion porosimetry.

As used herein, the term "mesh heater" refers to a heater comprising an arrangement of solid material which may be heated. The solid material is arranged to have a plurality of apertures extending therethrough. The mesh heater may, for example, comprise a network of wires, or a perforated sheet. The mesh heater may be heated by any suitable method. For example, the mesh heater, or parts thereof, may be resistively or inductively heated.

As used herein, the term "capillary action" refers to the ability of a liquid to flow in a narrow space without the assistance of, or even in opposition to, external forces like gravity. The effect of capillary action, or wicking, can be seen in the drawing up of liquids in thin tubes and in porous materials.

As used herein, the term "bulk liquid aerosol-forming substrate direction of travel" refers to a net direction of travel of the liquid aerosol-forming substrate.

As used herein, the term "planar" is used to mean substantially two-dimensional. A planar component may extend in a first direction and a second direction perpendicular to the first direction at least two, five, or ten times further than in a third direction perpendicular to the first and second directions.

As used herein, the term "flat" is used to refer to a substantially two dimensional topological manifold. Thus, a flat mesh heater may extend in two dimensions along a surface substantially more than in a third dimension. The dimensions of the flat mesh heater in the two dimensions within the surface may be at least 2, 5, or 10 times larger than in the third dimension, normal to the surface. An example of a substantially flat mesh heater is a structure between two substantially parallel surfaces, wherein the distance between these two imaginary surfaces is substantially smaller than the extension within the surfaces. In some embodiments, the substantially flat mesh heater is planar. In other embodiments, the substantially flat mesh heater is curved along one or more dimensions, for example forming a dome shape or bridge shape. In embodiments, the substantially flat mesh heater may engage with a surface of the porous ceramic body.

As used herein, the term "heater assembly" refers to the mesh heater and the porous ceramic body of the cartridge.

As used herein, the term "average" refers to an unweighted number mean unless otherwise specified. Thus, the "average" diameter of five wires will be equal to one fifth of the sum of the diameters of the five wires.

The porous ceramic body has a porosity of between 30% and 65%. The porous ceramic body may have a porosity less than 60%, 55%, 50%, or 45%. Alternatively, or in addition, the porous ceramic body may have a porosity of greater than 35%, 40%, or 45%.

For example, the porous ceramic body may have a porosity of between 30% and 60%, or 30% and 55%, or 30% and 50%, or 35% and 65%, or 35% and 60%, or 35% and 55%, or 35% and 50%, or 40% and 65%, or 40% and 60%, or 40% and 55%.

The porous ceramic body may be configured to supply a given flow rate of liquid aerosol-forming substrate to the mesh heater in use. For example, the porous ceramic body may be configured to supply at least 0.2, 0.5 or 1 microlitre per second of liquid aerosol-forming substrate to the mesh heater in use. The porous ceramic body may be configured to supply less than 3, 5, or 10 microlitres per second of liquid aerosol-forming substrate to the mesh heater in use. The porous ceramic body may be configured to supply between 1 and 3 microlitres per second of liquid aerosol-forming substrate to the mesh heater in use.

The term "porous ceramic body" may refer to a portion or a whole of a ceramic component. For example, the term porous ceramic body may refer only to a portion of a ceramic component in which liquid aerosol-forming substrate is held, or transported to the mesh heater.

The apertures of the mesh heater may each have a dimension of between 50 and 150 microns, or between 50 and 100 microns, or between 60 and 80 microns, or around 70 microns.

In use, the liquid aerosol-forming substrate may be drawn into the apertures of the mesh heater from the porous ceramic body. The liquid aerosol-forming substrate may be drawn into the apertures of the mesh heater by capillary action.

The mesh heater may be substantially flat. The mesh heater may be substantially planar. Advantageously, a flat or planar mesh heater may be easily handled during manufacture and may provide a robust heater assembly construction.

In use, a bulk liquid aerosol-forming substrate direction of travel may be substantially perpendicular to a plane of the mesh heater. This may advantageously improve transport of the liquid aerosol-forming substrate into the apertures of the mesh heater.

A portion, or all, of the mesh heater may be substantially parallel to a first surface of the porous ceramic body.

Advantageously, this may improve transport of the liquid aerosol-forming substrate into the apertures of the mesh heater from pores in the porous ceramic body, for example from pore openings in the first surface of the porous ceramic body.

The mesh heater, or a portion thereof, may be one or more of adjacent to, fixed relative to, secured to, engaged with and attached to porous ceramic body or the first surface of the porous ceramic body. For example, the mesh heater, or a portion thereof, may be embedded in the porous ceramic body. Where the mesh heater, or a portion thereof, is embedded in the porous ceramic body, the first surface may not be an external surface of the porous ceramic body. As used herein, the term "engaged with" may be used to mean fixed relative to, secured to, attached to or adhered to.

The mesh heater may be reversibly engaged with the porous ceramic body. It may be possible to engage the mesh heater with, and disengage the mesh heater from, the porous ceramic body. Alternatively, the mesh heater may be irreversibly engaged with the mesh heater.

When engaged with the porous ceramic body, the position of the mesh heater may be fixed. When engaged with the porous ceramic body, the mesh heater may be adjacent to, or in contact with, the porous ceramic body.

The mesh heater may be attached to the porous ceramic body. The mesh heater may be attached to the porous ceramic body by any suitable means. The mesh heater may be attached to the porous ceramic body by one or more of: one or more solder points, one or more mechanical fasteners such as clips or bolts, and a covering layer of a ceramic. The mesh heater may be embedded in the porous ceramic body.

The porous ceramic body may comprise a second surface substantially opposing the first surface. In use, the liquid aerosol-forming substrate may travel from the second surface to the first surface through the porous ceramic body. The liquid aerosol-forming substrate may travel through the porous ceramic body by capillary action. Alternatively, or in addition, an air flow past, across, or around the porous ceramic body or the mesh heater may cause a pressure gradient local to the porous ceramic body which aids travel of the liquid aerosol-forming substrate through the porous ceramic body.

The porous ceramic body may absorb, or be configured to absorb, liquid aerosol-forming substrate. For example, the porous ceramic body may absorb, or be configured to absorb, at least 0.01, 0.02, 0.05, 0.1, or 0.5 ml of liquid aerosol-forming substrate.

The cartridge may comprise a liquid aerosol-forming substrate storage component for storing the liquid aerosol-forming substrate. The liquid aerosol-forming substrate storage component may store liquid aerosol-forming substrate. The liquid aerosol-forming substrate storage component may be in fluid communication with the porous ceramic body, for example the second surface of the porous ceramic body.

The liquid aerosol-forming substrate storage component may comprise a reservoir or tank of liquid aerosol-forming substrate. The porous ceramic body may be in fluid communication with, or in contact with, the reservoir of liquid aerosol-forming substrate.

The liquid aerosol-forming substrate storage component may comprise a material soaked with liquid aerosol-forming substrate. The liquid aerosol-forming substrate storage component may be positioned to convey liquid to the porous ceramic body.

The liquid aerosol-forming substrate storage component may have a fibrous or spongy structure. The liquid aerosol-forming substrate storage component may comprise a capillary material. The liquid aerosol-forming substrate storage component may comprise a bundle of capillaries. For example, the liquid aerosol-forming substrate storage component may comprise one or more of a plurality of fibres or threads or fine bore tubes. The fibres, threads or tubes may be generally aligned to convey liquid to the porous ceramic body.

The liquid aerosol-forming substrate storage component may comprise sponge-like or foam-like material. The structure of the liquid aerosol-forming substrate storage component may form a plurality of small bores or tubes, through which the liquid can be transported by capillary action.

The liquid aerosol-forming substrate storage component may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The liquid aerosol-forming substrate storage component may have any suitable capillarity and porosity so as to be used with different liquid physical properties.

The cartridge may comprise a liquid aerosol-forming substrate storage component may be soaked with a liquid aerosol-forming substrate. The liquid aerosol-forming substrate storage component may be in contact with the porous ceramic body. The porous ceramic body may comprise a first portion. The first portion of the porous ceramic body may be located between the liquid aerosol-forming substrate storage component and the mesh heater. The first portion of the porous ceramic body may comprise a first surface and a second surface. The second surface may oppose the first surface. The mesh heater may be engaged with the first surface. The liquid aerosol-forming substrate storage component may be in contact with the second surface. The mesh heater may comprise a metal, for example a steel such as stainless steel.

The area of the mesh heater may be less than 50, 40, or 30 $mm^2$. This may allow the mesh heater to be incorporated in to a handheld system.

The mesh heater may comprise a network of wires. The wires may be interwoven. The mesh heater may comprise a woven or non-woven wire mesh. The wires may be electrically conductive.

The wires may lie in a single plane. The mesh heater may be planar. A planar mesh heater can be easily handled during manufacture and provides for a robust construction.

The apertures may be defined bounded by the wires. The wires may have a substantially circular, square, rectangular, hexagonal or irregular cross-section.

The wires may be individually formed and knitted together. The wires may be formed by etching a sheet material, such as a foil. This may be particularly advantageous when the mesh heater comprises an array of parallel wires. Alternatively, the wires may be stamped from electrically conductive foil, as for example stainless steel.

The mesh heater, or the wires, may comprise or be formed from any material with suitable electrical and mechanical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The wires may be coated with one or more electrical insulators. Preferred materials for the mesh heater or wires may be 304, 316, 304L, 316L stainless steel, and graphite. Additionally, the mesh heater or wires may comprise combinations of the above materials. A combination of materials may be used to improve the control of the resistance of the mesh heater. For example, materials with a high resistivity may be combined with materials with a low resistivity. This may be advantageous if one of the materials is more beneficial from other perspectives, for example price, machinability or other physical and chemical parameters.

The mesh heater may comprise at least one wire made from a first material and at least one wire made from a second material different from the first material. This may be beneficial for electrical or mechanical reasons. For example, one or more of the wires may be formed from a material having a resistance that varies significantly with temperature, such as an iron aluminium alloy. This allows a measure of resistance of the wires to be used to determine temperature or changes in temperature. This can be used in a puff detection system and for controlling heater temperature to keep it within a desired temperature range. Sudden changes in temperature may also be used as a means to detect changes in air flow past the mesh heater resulting from a user puffing on the system.

The mesh heater may comprise two or more types of wires that are formed into a wire mesh. The two types of wires may have different resistivities. Wires with a higher resistivity may be oriented in the direction of the flow of electric current, for example, wires made from a nickel chromium alloy. Wires with a lower resistivity may be arranged substantially perpendicular to the wires with higher resistivity. For example, the low resistive wires may be stainless steel wires. Advantageously, the relatively cheaper low resistance wires form the support for the wires with high electrical resistance. In addition, wires with high electrical resistance are typically less malleable than stainless steel wires and can thus not be manufactured easily into thin wires.

Alternatively, the mesh heater may comprise a carbon thread textile. Advantageously, a carbon thread textile is typically more flexible than a metallic mesh.

The wires may have an average diameter of at least 10, 16, 17, or 30 microns. The wires may have an average diameter of less than 100, 90, 80, 70, 60, 50, 40, or 30 microns. Preferably, the wires may have an average diameter of between 15 and 30 microns, or 15 and 20 microns, for example around 16 or 17 microns.

The wires may each have a minimum thickness of at least 10, 16, 17, or 30 microns. The wires may each have a minimum thickness of less than 100, 90, 80, 70, 60, 50, 40, or 30 microns.

The mesh heater may be a hybrid mesh heater. As used herein, the term "hybrid mesh heater" is used to refer to a mesh heater comprising at least one wire and at least one fibre. The mesh heater may comprise a network of wires and fibres. Features and properties of the wires described above are equally applicable to the wires in the hybrid mesh heater.

The fibres may have a different material composition to the wires. The wires and fibres may be interwoven. Thus, the mesh heater may comprise a woven wire and fibre mesh. The fibres may have an average diameter between 80% and 120% of an average diameter of the wires. The wires and fibres may have substantially identical average diameters.

The wires may be substantially perpendicular to the fibres.

The fibres may have an average diameter of at least 10, 16, 17, or 30 microns. The fibres may have an average diameter of less than 100, 90, 80, 70, 60, 50, 40, or 30 microns. Preferably, the fibres may have an average diameter of between 15 and 30 microns, or 15 and 20 microns, for example around 16 or 17 microns. The fibres may comprise glass fibres. The fibres may comprise rayon fibres.

The fibres may each have a minimum thickness of at least 10, 16, 17, or 30 microns. The fibres may each have a minimum thickness of less than 100, 90, 80, 70, 60, 50, 40, or 30 microns.

The thickness of the mesh heater may be at least 30, 40 or 48 microns. Where the mesh heater comprises wires, or wires and fibres, a thickness of the mesh heater may be approximately 3 times the average diameter of the wires or fibres. For example, the thickness of the mesh heater may be between 2.5 and 3.5 times the average diameter of the wires or fibres. The thickness of the mesh heater may be less than 300, 250, 200, 150, or 100 microns. The thickness of the mesh heater may be between 45 and 100, or 45 and 80, or 45 and 60 microns.

The mesh heater may comprise a sheet. The sheet may be metallic. The sheet may comprise a metal such as stainless steel. The sheet may comprise the plurality of apertures. The sheet may be perforated. The plurality of apertures may comprise the perforations in the sheet. The sheet may comprise a heating track, or a heating track may be deposited on the sheet. As used herein, the term "heating track" is used to refer to a track, path, or section of a material which is configured to be heated in use. For example, in use, a current may be passed through the heating track in order to resistively heat the heating track. In this case, the heating track may comprise an electrically conductive material. Alternatively, the heating track may comprise a susceptor material and, in use, the heating track may be inductively heated.

The mesh heater may be engaged with the porous ceramic body, or the first surface of the porous ceramic body, over substantially an entirety of a face of the mesh heater. The mesh heater may be in contact with the porous ceramic body or the first surface of the porous ceramic body. The mesh heater may be in contact with the porous ceramic body, or the first surface of the porous ceramic body, over substantially an entirety of a face of the mesh heater. The mesh heater may be engaged with the porous ceramic body, or the first surface of the porous ceramic body such that, at no point is there a spacing between the porous ceramic body and the mesh heater of more than 500, 300, 100, 75, 50, or 25 microns. All points of the mesh heater may be within 500, 300, 100, 75, 50, or 25 microns of at least one point on the porous ceramic body, or on the first surface of the porous ceramic body. Advantageously, minimising any spacing between the mesh heater and the porous ceramic body may improve the transport of liquid aerosol-forming substrate from the porous ceramic body into the apertures of the mesh heater.

The porous ceramic body may comprise a material with a relatively low linear coefficient of thermal expansion, for example a linear coefficient of thermal expansion at 25 degrees Celsius which is less than 30, 20, or $10\times10^{-6}$ m/(m K). Advantageously, a lower coefficient of thermal expansion may reduce the risk of particles from the porous ceramic body breaking off from the body when the porous ceramic body is heated by the mesh heater. Where the mesh heater is in contact with the porous ceramic body, this risk may be particularly high at the contact points between the mesh heater and the porous ceramic body.

The porous ceramic body may comprise a material which has a linear coefficient of thermal expansion at 25 degrees Celsius which is between 30% and 300% of the linear coefficient of thermal expansion at 25 degrees Celsius of a material of the mesh heater. Advantageously, this may reduce the risk of particles from the porous ceramic body breaking off from the body when the porous ceramic body is heated by the mesh heater.

The porous ceramic body may comprise one or more of steatite, alumina and zirconia. Advantageously, these materials are chemically stable and have relatively low coefficients of thermal expansion.

The porous ceramic body may comprise pores which have an average pore size of less than 40, 30, 20, 10, or 8 microns. The porous ceramic body may comprise pores which have an average pore size of greater than 2.5, 5, 10, or 20 microns. The porous ceramic body may comprise pores which have an average pore size of between 2.5 and 40 microns, or 2.5 and 30 microns, or 2.5 and 20 microns, or 2.5 and 10 microns, or 2.5 and 8 microns, or 5 and 40 microns, or 5 and 30 microns, or 5 and 20 microns, or 5 and 10 microns, or 10 and 40 microns, or 10 and 30 microns, or 10 and 20 microns, or 20 and 40 microns, or 20 and 30 microns, or 30 and 40 microns.

A preferable porous ceramic body may have a porosity of between 30% and 60% and have pores which have an average pore size of between 5 and 30 microns. A particularly preferable porous ceramic body may have a porosity of between 40% and 60% and have pores which have an average pore size of between 5 and 10 microns. Another particularly preferable porous ceramic body may have a porosity of between 30% and 40% and have pores which have an average pore size of between 20 and 30 microns.

The porous ceramic body may comprise a first portion and a projection. The projection may be located at a periphery of the first portion. The projection may extend around substantially a whole of the periphery of the first portion. The projection may extend substantially perpendicularly from a surface of the first portion. Advantageously, the projection may allow the porous ceramic body to withstand greater forces during manufacturing and assembly without breaking.

The first portion may comprise a length, a width perpendicular to the length, and a thickness perpendicular to the length and the width. The length and the width may be at least two, three, or five times the thickness.

The first portion may have a substantially circular cross-section. The first portion may have a diameter and a thickness. The diameter may be at least two, three, or five times the thickness.

The first portion may have a thickness of at least 1, 1.5, 2, or 2.5 mm. Advantageously, a larger thickness may improve the strength of the first portion of the porous ceramic body. The first portion may have a thickness of less than 6, 5, or 4 mm. Advantageously, a smaller thickness may improve the wicking capability of the first portion, thus improving the transport of liquid aerosol-forming substrate through the first portion. Thus, the first portion may have a thickness between 1 and 6 mm, or 1 and 5 mm, or 1.5 and 5 mm, or 1.5 and 4 mm.

The projection may have a width of at least 1, 1.5, 2, or 2.5 mm. The projection may have a width of less than 6, 5, or 4 mm. Thus, the projection may have a width between 1 and 6 mm, or 1 and 5 mm, or 1.5 and 5 mm, or 1.5 and 4 mm. The width of the projection may be between 50% and 150% of the thickness of the first portion.

The first portion of the porous ceramic body may be located between the liquid aerosol-forming substrate storage component and the mesh heater. The first portion of the porous ceramic body may comprise a first surface and a second surface. The second surface may oppose the first surface. The mesh heater may be engaged with the first surface. The liquid aerosol-forming substrate storage component may be in contact with the second surface. The projection may extend from the second surface. The projection may encircle the liquid aerosol-forming substrate storage component.

The porous ceramic body may comprise a channel extending therethrough. The first portion of the porous ceramic body may comprise the channel. The channel may extend through the first portion. The channel may extend substantially in a thickness direction of the first portion. The mesh heater may be substantially flat or planar and the channel may extend substantially perpendicularly to a plane of the mesh heater. The channel may have a diameter of at least 300, 400 or 500 microns. The channel may have a diameter of less than 800, 700, or 600 microns. Advantageously, the channel may increase the porosity of the porous ceramic body. This may allow the porous ceramic body to hold more liquid aerosol-forming substrate. Further, the channel may improve the wicking capability of the porous ceramic body. Thus, the channel may improve transport of the liquid aerosol-forming substrate through the porous ceramic body.

The mesh heater may be attached to the porous ceramic body by a solder point or by multiple solder points. The solder point or solder points may comprise silver or tin.

The mesh heater may be attached to the porous ceramic body by: providing a segment, or multiple segments, of metal between the porous ceramic body and the mesh heater (for example by applying the segment(s) of metal to the porous ceramic body, or by coating the mesh heater with the metal); locating the mesh heater engaged with the porous ceramic body; melting the segment(s) of metal, optionally while forcing the mesh heater and the porous ceramic body towards each other; and solidifying the segment(s) of metal. As the segment(s) of metal solidifies, the segment(s) of metal adheres the porous ceramic body to the mesh heater.

The mesh heater may be attached to the porous ceramic body by: providing a segment, or multiple segments, of metal between the mesh heater and the porous ceramic body (for example by applying the segment(s) of metal to the porous ceramic body, or by coating the mesh heater with the metal); and forcing the mesh heater and the porous ceramic body towards each other, optionally while heating the segment(s) of metal. The segment(s) of metal may adhere the porous ceramic body to the mesh heater.

Where multiple segments of metal are used, these segments may be spaced apart, for example spaced in the plane of the mesh heater. One or more of the segments may be, or may comprise, a blob or portion of metal on the porous ceramic body or on the mesh heater. Thus, there may be multiple spaced blobs or portions of metal on the porous ceramic body or on the mesh heater or on both the porous ceramic body and on the mesh heater.

Thus, by attaching the mesh heater to the porous ceramic body as described above, the cartridge may comprise a segment of metal between the porous ceramic body and the mesh heater. The segment of metal may comprise silver or tin. It should be noted, however, that the cartridge may comprise the segment of metal between the porous ceramic body and the mesh heater for another reason.

The segment of metal may adhere the porous ceramic body to the mesh heater. The segment of metal may comprise silver or tin.

The mesh heater, or a portion thereof, may comprise a full or partial metal coating. The metal coating may comprise tin or silver. This may be the case where the segment(s) of metal are applied by coating the mesh heater with metal.

The mesh heater may be attached to the porous ceramic body by: locating the mesh heater engaged with the porous ceramic body; and depositing a covering layer of a second ceramic on the mesh heater such that at least part of the mesh heater is between the porous ceramic body and the covering layer of a second ceramic. The porous ceramic body, or the covering layer of the second ceramic, or both the porous ceramic body and the covering layer of the second ceramic, may then be sintered. Alternatively, or in addition, the porous ceramic body, or the covering layer of the second ceramic, or both the porous ceramic body and the covering layer of the second ceramic, may have been sintered before the covering layer of the second ceramic is deposited on the mesh heater.

Features and properties of the porous ceramic body may also apply to the covering layer of the second ceramic. For example, features and properties relating to the material, material properties, pore sizes, and porosity may all apply to the covering layer of the second ceramic.

Thus, by attaching the mesh heater to the porous ceramic body as described above, the mesh heater may be located between the porous ceramic body and a covering layer of a second ceramic. It should be noted, however, that the cartridge may comprise the covering layer of the second ceramic for another reason.

The covering layer of the second ceramic may comprise a ceramic material. The porous ceramic body may also comprise the ceramic material. Thus, both the porous ceramic body and the covering layer of the second ceramic may comprise one or more of alumina, steatite, and zirconia.

The covering layer of the second ceramic may have a thickness of less than 5000, 1000, 500, or 200 microns. The covering layer of the second ceramic may have a thickness of at least 10, 100, 500, or 1000 microns. Thus, the covering layer of the second ceramic may have a thickness of between, 500 and 5000 microns, for example between 1000 and 2000 microns.

The covering layer of the second ceramic may be in contact with the mesh heater. The covering layer of the second ceramic may be in contact with the porous ceramic body. The mesh heater may be attached to the porous ceramic body by the covering layer of the second ceramic.

The covering layer of the second ceramic may cover less than 80%, or 65%, or 50% of a surface of the mesh heater. This may improve generation of aerosol compared with the covering layer of the second ceramic covering a larger proportion of the surface of the mesh heater.

The cartridge may comprise an air inlet. The cartridge may comprise an air outlet. The air inlet may be in fluid communication with the air outlet. The mesh heater may be disposed downstream of the air inlet. The mesh heater may be disposed upstream of the air outlet.

The cartridge may comprise a mouthpiece. The mouthpiece may be, or may comprise, the air outlet. In use, when the cartridge is coupled with an aerosol-generating device, a user may puff on the mouthpiece of the cartridge. This may cause air to flow in through the air inlet, then across, over, past, or through the mesh heater, then through the air outlet.

The cartridge may comprise first and second electrical contacts electrically connected to the mesh heater. The electrical contacts may comprise one or more of tin, silver, gold, copper, aluminium, steel such as stainless steel, phosphor bronze, tin alloyed with antimony, tin alloyed with zirconium, tin alloyed with bismuth, or tin alloyed with other components improving resistance to organic acids.

The electrical contacts may be fixed directly to wires of the mesh heater. The electrical contacts may be positioned between the wires and the porous ceramic body. For example, the contacts may be formed from tin or silver that is plated or otherwise attached to the porous ceramic body. The contacts may bond more readily with the wires than the porous ceramic body would. The electrical contacts may be integral with the wires. For example, the mesh heater may be formed by etching an electrically conductive sheet to provide a plurality of wires between two electrical contacts.

The electrical contacts may be configured to form an electrical connection with corresponding electrical contacts on an aerosol-generating device when the cartridge is coupled with the device.

According to a third embodiment of the present disclosure, there is provided an aerosol-generating system comprising an aerosol-generating device and a cartridge. The cartridge may be a cartridge according to the first embodiment. The cartridge may be a cartridge according to the second embodiment.

The aerosol-generating device may be configured to couple with the cartridge. For example, the aerosol-generating device may be configured to couple to, and uncouple from, the cartridge. The aerosol-generating device may be configured to couple to, and uncouple from, the cartridge via a snap-fit connection, corresponding screw threads or any other suitable means. The aerosol-generating device may be configured to receive at least a portion of the cartridge. For example, the aerosol-generating device may comprise a chamber configured to receive at least a portion of the cartridge.

The aerosol-generating device may comprise an air inlet. The aerosol-generating device may comprise an air outlet. The air outlet of the aerosol-generating device may be in fluid communication with the air inlet of the cartridge.

The aerosol-generating device may comprise a power supply, such as a battery. When the cartridge is coupled with the device, the power supply may be configured to supply power to the mesh heater, for example to resistively heat the mesh heater.

The power supply may be electrically connected to first and second electrical contacts of the device. These first and second electrical contacts may be configured to form an electrical connection with corresponding electrical contacts on the cartridge when the cartridge is coupled with the device. The mesh heater may be configured to be resistively heated. The mesh heater may be, or may comprise, wires or an electrically resistive track connected to the electrical contacts on the cartridge. The wires or track may heat up as the power supply passes a current through the wires or the track. Thus, when the cartridge is coupled with the aerosol-generating device, the power supply in the aerosol-generating device may be configured to supply power to the mesh heater. That is, the power supply may be able to pass a current through the mesh heater, or wires or a track of the mesh heater, and resistively heat the mesh heater.

The cartridge or the aerosol-generating device may comprise an inductor, for example an induction coil. The mesh heater may be, or may comprise, a susceptor material.

The power supply may be configured to pass a current through the inductor such that the inductor generates a fluctuating electromagnetic field. This, in turn, may generate eddy currents and hysteresis losses in the susceptor material. This may cause the susceptor material to heat up. Thus, the power supply and the inductor may be configured to inductively heat the mesh heater.

The susceptor material may be, or may comprise, any material that can be inductively heated to a temperature sufficient to generate an aerosol from the aerosol-forming substrate. Preferred susceptor materials may be heated to a temperature in excess of 100, 150, 200 or 250 degrees Celsius. Preferred susceptor materials may comprise a metal or carbon. A preferred susceptor material may comprise a ferromagnetic material, for example ferritic iron, or a ferromagnetic steel or stainless steel. A suitable susceptor element may be, or comprise, aluminium. Preferred susceptor materials may comprise or be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor material such as material type and size may be altered to provide a desired power dissipation within a known electromagnetic field.

The inductor may be an induction coil. The induction coil may be located in the cartridge. The induction coil may be disposed around the mesh heater. For example, the induction coil may spiral around the mesh heater. The inductor may be electrically connected to electrical contacts on the cartridge. When the cartridge is coupled with the aerosol-generating device, these electrical contacts may be electrically connected to corresponding electrical contacts on the device which are electrically connected to the power supply in the device. Thus, when the cartridge is coupled with the device, the power supply of the device may be configured to pass a current through the inductor to generate a fluctuating electromagnetic field and thereby heat the susceptor material of the mesh heater.

The inductor, such as an induction coil, may be located in the aerosol-generating device. The inductor may be electrically connected to the power supply. The aerosol-generating device may comprise a chamber for receiving at least a portion of the cartridge. The induction coil may be disposed around at least part of this chamber. For example, the induction coil may spiral around at least part of the chamber. As such, when the cartridge, or a portion thereof, is received in the chamber, the induction coil may be disposed around, or spiral around, the mesh heater. Thus, when the cartridge is coupled with the device, the power supply of the device may be configured to pass a current through the inductor to generate a fluctuating electromagnetic field and thereby heat the susceptor material of the mesh heater.

The aerosol-generating device may comprise a controller. The controller may be configured to control supply of power from the power supply. Thus, the controller may control heating of the mesh heater.

Below, there is provided a non-exhaustive list of non-limiting examples. These examples are set out in clauses. Any one or more of the features of these examples may be combined with any one or more features of another example, embodiment, or aspect described herein.

A. A cartridge for use in an aerosol-generating system, the cartridge comprising:

a porous ceramic body having a porosity of between 30% and 65%; and a mesh heater engaged with the porous ceramic body, the mesh heater including a plurality of apertures, each aperture each having a dimension between 50 microns and 200 microns.

B. A cartridge according to clause A, wherein, in use, the liquid aerosol-forming substrate is drawn into the apertures of the mesh heater from the porous ceramic body.

C. A cartridge according to clause A or B, wherein, in use, the liquid aerosol-forming substrate is drawn into the apertures of the mesh heater by capillary action.

D. A cartridge according to any preceding clause, wherein the mesh heater is substantially flat or substantially planar.

E. A cartridge according to clause D, wherein, in use, a bulk liquid aerosol-forming substrate direction of travel is substantially perpendicular to a plane of the mesh heater.

F. A cartridge according to any preceding clause, wherein the mesh heater, or a portion thereof, is substantially parallel to a first surface of the porous ceramic body.

G. A cartridge according to clause F, wherein the mesh heater is attached to the first surface of the porous ceramic body.

H. A cartridge according to clause F or G, wherein the porous ceramic body comprises a second surface substantially opposing the first surface.

I. A cartridge according to clause H, wherein, in use, the liquid aerosol-forming substrate travels in a direction from the second surface to the first surface, for example from the second surface to the first surface.

J. A cartridge according to any preceding clause, wherein the cartridge comprises a liquid aerosol-forming substrate storage component for storing the liquid aerosol-forming substrate.

K. A cartridge according to clause J, wherein the liquid aerosol-forming substrate storage component is in fluid communication with the porous ceramic body.

L. A cartridge according to clause H or I, wherein the cartridge comprises a liquid aerosol-forming substrate storage component for storing the liquid aerosol-forming substrate and the liquid aerosol-forming substrate storage component is in fluid communication with the second surface of the porous ceramic body.

M. A cartridge according to any preceding clause, wherein the mesh heater comprises a metal.

N. A cartridge according to clause M, wherein the mesh heater comprises a steel.

O. A cartridge according to any preceding clause, wherein the mesh heater comprises a network of wires.

P. A cartridge according to clause O, wherein the mesh heater comprises a woven wire mesh.

Q. A cartridge according to any preceding clause, wherein the mesh heater is a hybrid mesh heater comprising a network of wires and fibres, and the fibres have a different material composition to the wires.

R. A cartridge according to clause Q, wherein the wires comprise a metal.

S. A cartridge according to clause R, wherein the wires comprise a steel.

T. A cartridge according to any of clauses Q to S, wherein the wires are substantially perpendicular to the fibres.

U. A cartridge according to any of clauses Q to T, wherein the mesh heater comprises a woven wire and fibre mesh.

V. A cartridge according to any of clauses Q to U, wherein the fibres have an average diameter between 80% and 120% of an average diameter of the wires.

W. A cartridge according to any of clauses Q to V, wherein the fibres have an average diameter of at least 10 microns.

X. A cartridge according to any of clauses Q to W, wherein the fibres have an average diameter of less than 100 microns.

Y. A cartridge according to any of clauses Q to X, wherein the fibres are glass fibres.

Z. A cartridge according to any of clauses Q to X, wherein the fibres are rayon fibres.

AA. A cartridge according to any of clauses O to Z, wherein the wires have an average diameter of at least 10 microns.

AB. A cartridge according to any of clauses O to AA, wherein the wires have an average diameter of less than 100 microns.

AC. A cartridge according to any of clauses A to N, wherein the mesh heater comprises a sheet.

AD. A cartridge according to clause AC, wherein the sheet is metallic.

AE. A cartridge according to clause AC or AD, wherein the sheet comprises the plurality of apertures.

AF. A cartridge according to any of clauses AC to AE, wherein the sheet is perforated.

AG. A cartridge according to any of clauses AC to AF, wherein the sheet comprises a heating track deposited thereon.

AH. A cartridge according to any preceding clause, wherein the mesh heater is substantially flat or substantially planar and a thickness of the mesh heater is greater than 30 microns.

AI. A cartridge according to any preceding clause, wherein the mesh heater is engaged with the porous ceramic body over substantially an entirety of a face of the mesh heater.

AJ. A cartridge according to clause AI, wherein the mesh heater is in contact with the porous ceramic body over substantially the entirety of the face of the mesh heater.

AK. A cartridge according to any preceding clause, wherein the porous ceramic body comprises one or more of steatite, alumina and zirconia.

AL. A cartridge according to any preceding clause, wherein the porous ceramic body comprises pores with an average pore size between 2.5 microns and 40 microns.

AM. A cartridge according to any preceding clause, wherein the porous ceramic body comprises a first portion and a projection.

AN. A cartridge according to clause AM, wherein the projection is located at a periphery of the first portion.

AO. A cartridge according to clause AN, wherein the projection extends around substantially a whole of the periphery of the first portion.

AP. A cartridge according to any of clauses AM to AO, wherein the projection extends substantially perpendicularly from a surface of the first portion.

AQ. A cartridge according to any of clauses AM to AP, wherein the first portion comprises a length, a width perpendicular to the length, and a thickness perpendicular to the length and the width, and the length and the width are at least twice the thickness.

AR. A cartridge according to any of clauses AM to AP, wherein the first portion has a substantially circular cross-section.

AS. A cartridge according to clause AR, wherein the first portion has a diameter and a thickness, and the diameter is at least twice the thickness.

AT. A cartridge according to any of clauses AM to AS, wherein the first portion has a thickness of at least 1.5 mm.

AU. A cartridge according to any of clauses AM to AT, wherein the first portion has a thickness of less than 6 mm.

AV. A cartridge according to any of clauses AM to AU, wherein the projection has a width of at least 1.5 mm.

AW. A cartridge according to any of clauses AM to AV, wherein the projection has a width of less than 6 mm.

AX. A cartridge according to any preceding clause, wherein the porous ceramic body comprises a channel extending therethrough.

AY. A cartridge according to any of clauses AM to AW, wherein the first portion of the porous ceramic body comprises a channel extending therethrough.

AZ. A cartridge according to clause AY, wherein the channel extends substantially in a thickness direction of the first portion.

BA. A cartridge according to clause AX, AY or AZ, wherein the mesh heater is substantially flat or substantially planar and the channel extends substantially perpendicularly to a plane of the mesh heater.

BB. A cartridge according to any of clauses AX to BA, wherein the channel has a diameter of at least 300 microns.

BC. A cartridge according to any of clauses AX to BB, wherein the channel has a diameter of less than 800 microns.

BD. A cartridge according to any preceding clause, wherein the mesh heater is attached to the porous ceramic body by a solder point.

BE. A cartridge according to clause BD, wherein the solder point comprises silver or tin.

BF. A cartridge according to any preceding clause, comprising a segment of metal located between the porous ceramic body and the mesh heater.

BG. A cartridge according to clause BF, wherein the mesh heater is adhered to the porous ceramic body by the segment of metal.

BH. A cartridge according to clause BF or BG, wherein the segment of metal comprises silver or tin.

BI. A cartridge according to any preceding clause, wherein the mesh heater is located between the porous ceramic body and a covering layer of a second ceramic.

BJ. A cartridge according to clause BI, wherein the covering layer of the second ceramic comprises a ceramic material and the porous ceramic body comprises the ceramic material.

BK. A cartridge according to clause BI or BJ, wherein the covering layer of the second ceramic has a thickness of less than 5000 microns.

BL. A cartridge according to clause BI, BJ or BK, wherein the covering layer of the second ceramic has a thickness of at least 10 microns.

BM. A cartridge according to any of clauses BI to BL, wherein the covering layer of the second ceramic covers less than 80% of a surface of the mesh heater.

BN. A cartridge according to any of clauses BI to BM, wherein the covering layer of the second ceramic is in contact with the mesh heater.

BO. A cartridge according to any of clauses BI to BN, wherein the mesh heater is attached to the porous ceramic body by the covering layer of the second ceramic.

BP. A cartridge according to any preceding clause, the cartridge comprising an electrical contact electrically connected to the mesh heater.

BQ. A cartridge according to clause BP, wherein the electrical contact comprises tin, silver, gold, copper, aluminium, steel such as stainless steel, phosphor bronze, tin alloyed with antimony, tin alloyed with zirconium, tin alloyed with bismuth, or tin alloyed with other components improving resistance to organic acids.

BR. An aerosol-generating system comprising an aerosol-generating device and a cartridge according to any preceding clause.

BS. An aerosol-generating system according to clause BR, wherein the aerosol-generating device is configured to couple with the cartridge.

BT. An aerosol-generating system according to clause BR or BS, wherein the aerosol-generating device comprises a power supply configured to supply power to the mesh heater to resistively heat the mesh heater.

BU. An aerosol-generating system according to clause BR or BS, wherein the aerosol-generating device comprises a power supply, and the cartridge or the aerosol-generating device comprise an inductor, and the power supply and the inductor are configured to inductively heat the mesh heater.

Examples will now be further described with reference to the figures in which.

Figure 1:
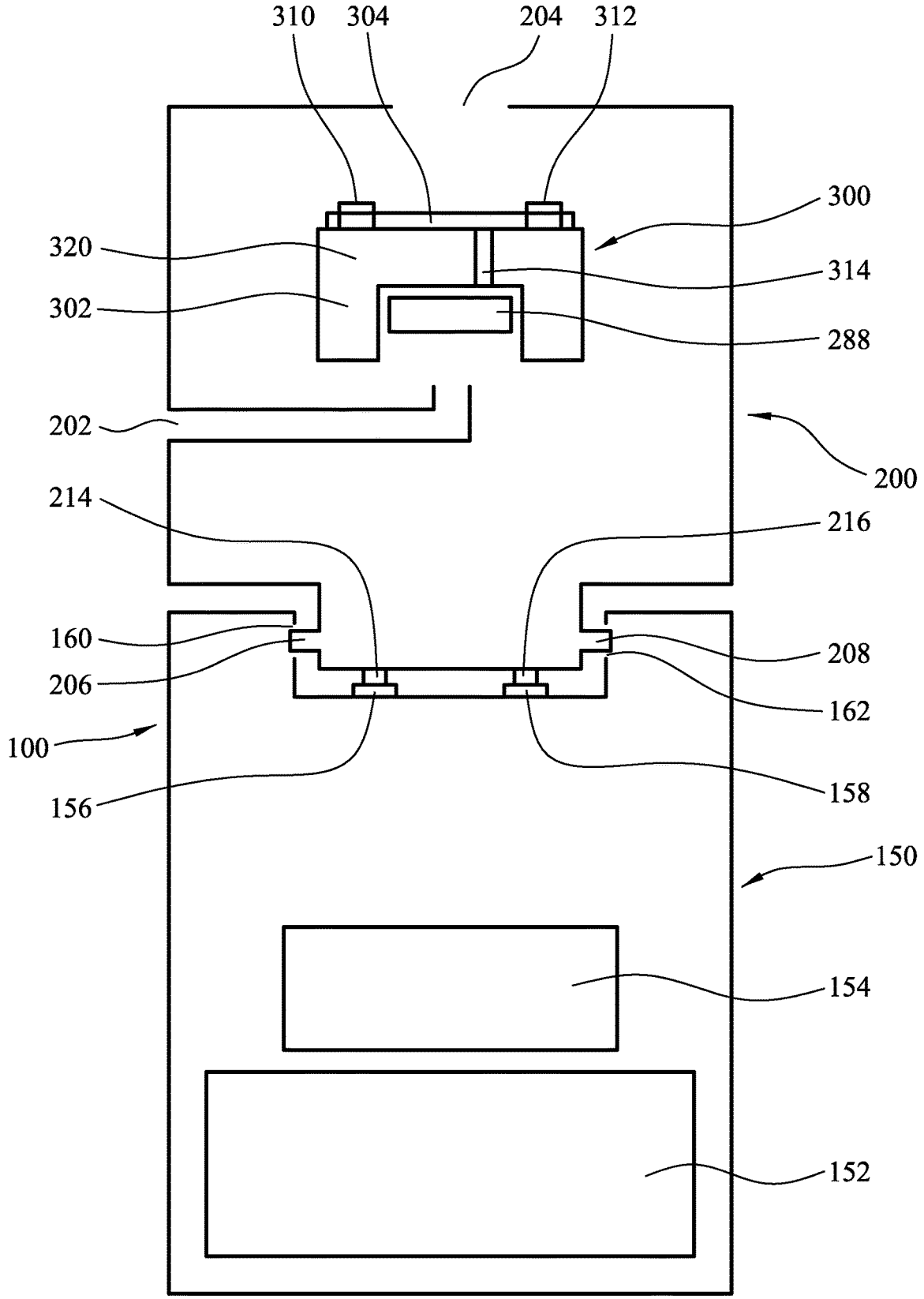
FIG. 1 shows a cross-sectional view of an aerosol-generating system incorporating a cartridge with a first heater assembly.

FIG. 1 shows a cross-sectional view of an aerosol-generating system 100. The aerosol-generating system 100 comprises an aerosol-generating device 150 and a cartridge 200. In this example, the aerosol-generating system 100 is an electrically operated smoking system.

The aerosol-generating device 150 is portable and has a size comparable to a conventional cigar or cigarette. The device 150 comprises a battery 152, such as a lithium iron phosphate battery, and a controller 154 electrically connected to the battery 152. The device 150 also comprises two electrical contacts 156, 158 which are electrically connected to the battery 152. This electrical connection is a wired connection and is not shown in FIG. 1.

The cartridge 200 comprises an air inlet 202, an air outlet 204, and a first heater assembly 300. The air inlet 202 is in fluid communication with the air outlet 204. The heater assembly 300 is positioned downstream of the air inlet 202 and upstream of the air outlet 204. The heater assembly 300 comprises a porous ceramic body 302, and a substantially planar mesh heater 304 engaged with the porous ceramic body 302.

The mesh heater 304 comprises a hybrid mesh comprising stainless steel wires 306 and glass fibres 308. The stainless steel wires 306 are interwoven with, and substantially perpendicular to, the glass fibres 308. Thus, the mesh heater 304 comprises a woven hybrid mesh. The mesh heater 304 is attached to the porous ceramic body 302 by two solder points 310, 312. In this example, the solder points 310, 312 are formed from tin, though silver or another suitable material could be used. Each of these solder points 310, 312 is electrically connected to an electrical contact 214, 216 on the cartridge. This electrical connection is a wired connection and is not shown in FIG. 1. Via this electrical connection, the stainless steel wires 306 are electrically connected to the electrical contacts 214, 216.

The porous ceramic body 302 comprises a number of pores. A liquid aerosol-forming substrate is held in the pores of the porous ceramic body 302.

In FIG. 1, the aerosol-generating device 150 is coupled with the cartridge 200. In this example, the cartridge 200 is coupled with the aerosol-generating device 150 via protrusions 206, 208 which form a snap-fit connection with corresponding apertures 160, 162 on the aerosol-generating device 150.

The cartridge 200 additionally comprises a liquid aerosol-forming substrate storage component 288 which is in fluid communication with the porous ceramic body 302. The liquid aerosol-forming substrate storage component 288 is in contact with a first portion 320 of the porous ceramic body 302. The liquid aerosol-forming substrate storage component 1008 may be adhered to the porous ceramic body 302 with glue, or may be held in place by friction, or may be held in place by another suitable means. The liquid aerosol-forming substrate storage component 288 in this example is a capillary material having a fibrous or spongy structure, though in other embodiments a reservoir or tank of liquid aerosol-forming substrate could be used. The capillary material is formed form polyester, though any suitable material could be used. The capillary material is soaked with aerosol-forming substrate. Thus, in FIG. 1, aerosol-forming substrate is stored in the pores of the porous ceramic body 302 and in the liquid aerosol-forming substrate storage component 288.

In use, a user puffs on the air outlet 204 of the cartridge 200. At the same time, the user presses a button (not shown) on the aerosol-generating device 150. Pressing this button sends a signal to the controller 154, which results in power being supplied from the battery 152 to the mesh heater 302 via the electrical contacts 156, 158 of the device and the electrical contacts 214, 216 of the cartridge. This causes a current to flow through the stainless steel wires 306 of the mesh heater 304, thereby resistively heating the stainless steel wires 306 and causing the mesh heater 304 as a whole to heat up. In other examples, an air flow sensor, or pressure sensor, is located in the cartridge 200 and electrically connected to the controller 154. The air flow sensor, or pressure sensor, detects that a user is puffing on the air outlet 204 of the cartridge 200 and sends a signal to the controller 154 to provide power to the mesh heater 304. In these examples, there is therefore no need for the user to press a button to heat the mesh heater 304. The liquid aerosol-forming substrate held in the pores of the porous ceramic body 302 is drawn into apertures of the mesh heater 304 by capillary action. The mesh heater 304 heats this liquid aerosol-forming substrate to vaporise the aerosol-forming substrate.

As liquid aerosol-forming substrate is drawn from the porous ceramic body 302 into the apertures of the mesh heater 304 and vaporised, liquid aerosol-forming substrate is also drawn from the liquid aerosol-forming substrate storage component 288 into the porous ceramic body 302. Thus, a user may be able to generate more aerosol than if the liquid aerosol-forming substrate storage component 288 were not present.

As the user puffs on the air outlet 204 of the cartridge 200, air is drawn into the air inlet 202. This air then travels around the heater assembly 300 and towards the air outlet 204. This flow of air entrains the vapour formed by heating of the liquid aerosol-forming substrate by the mesh heater 304. This entrained vapour then cools and condenses to form an aerosol. This aerosol is then delivered to the user via the air outlet 204.

Figure 2:
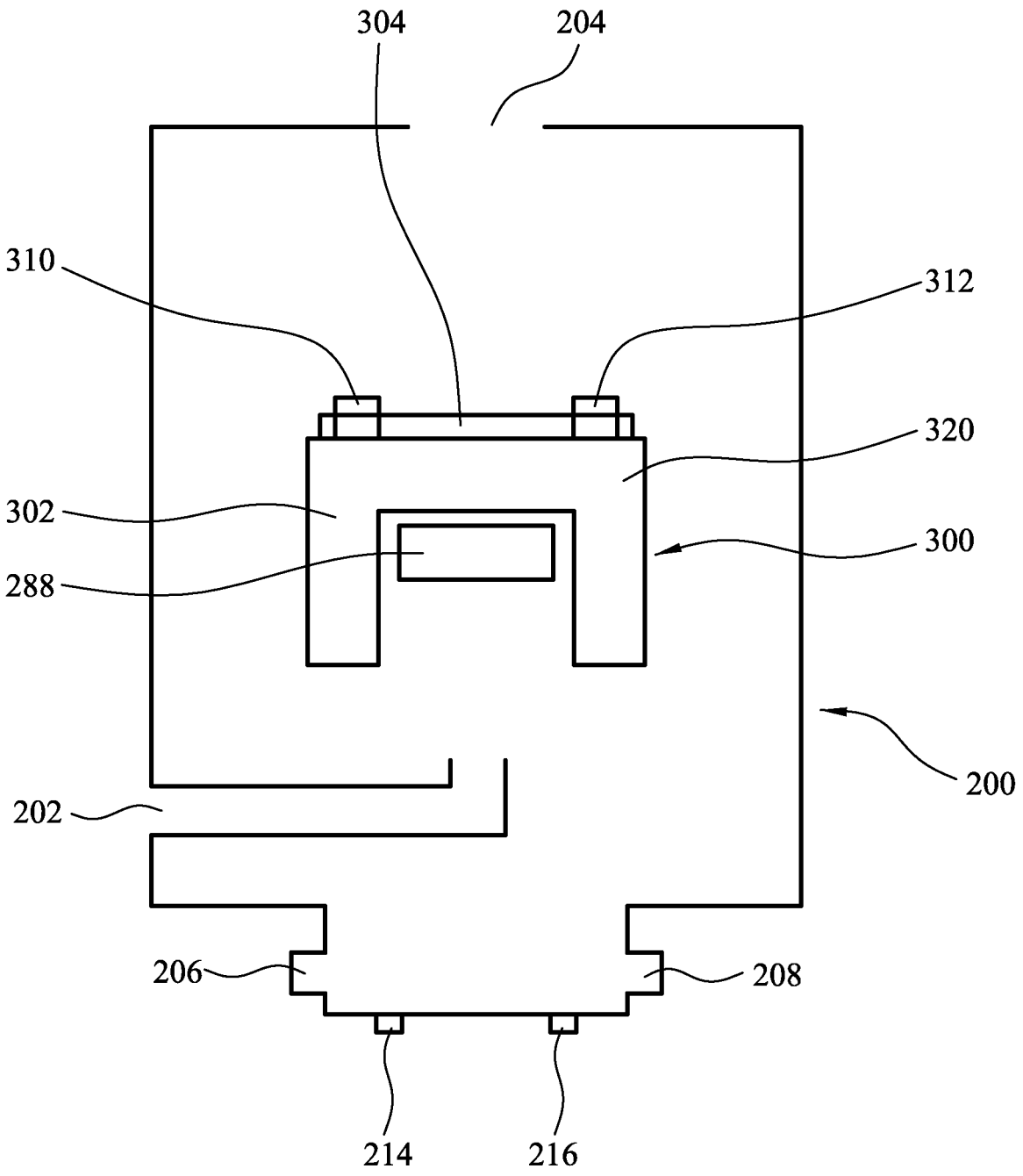
FIG. 2 shows a cross-sectional view of the cartridge incorporating the first heater assembly.

FIG. 2 shows a cross-sectional view of the cartridge 200 incorporating the first example of a heater assembly 300. In FIG. 2, the cartridge 200 is no longer coupled with the aerosol-generating device 150.

Figure 3:
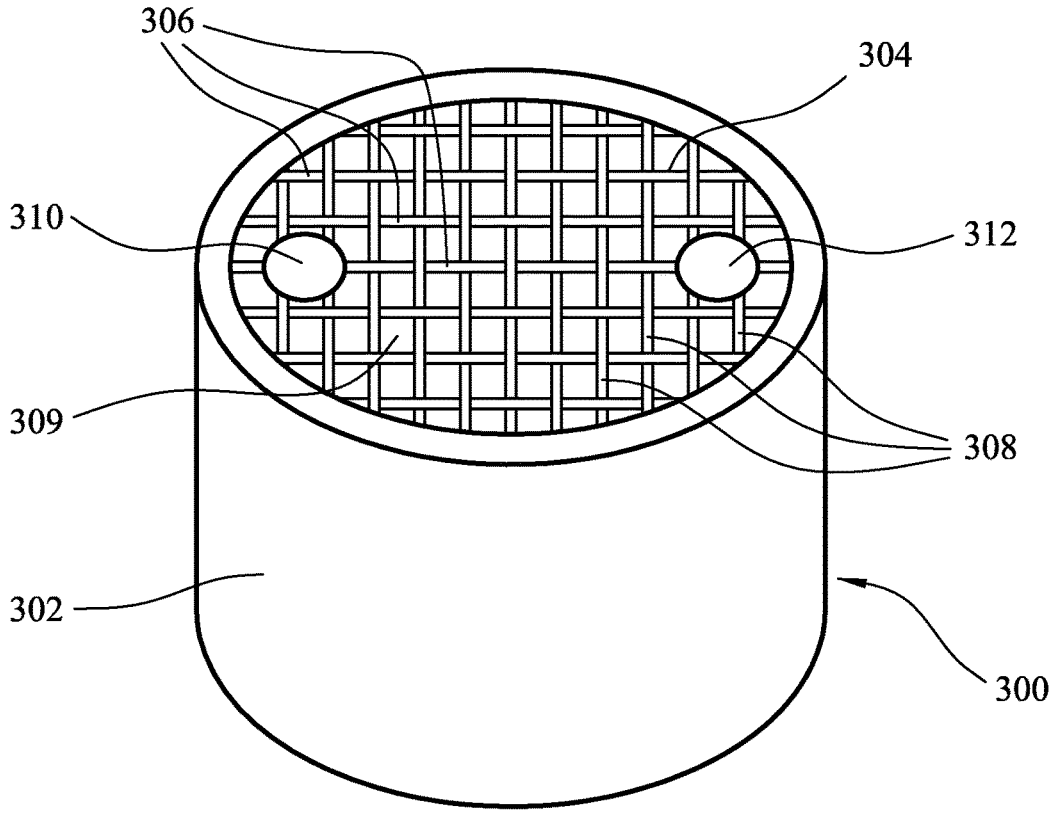
FIG. 3 shows a perspective view of the first heater assembly.
Figure 4:
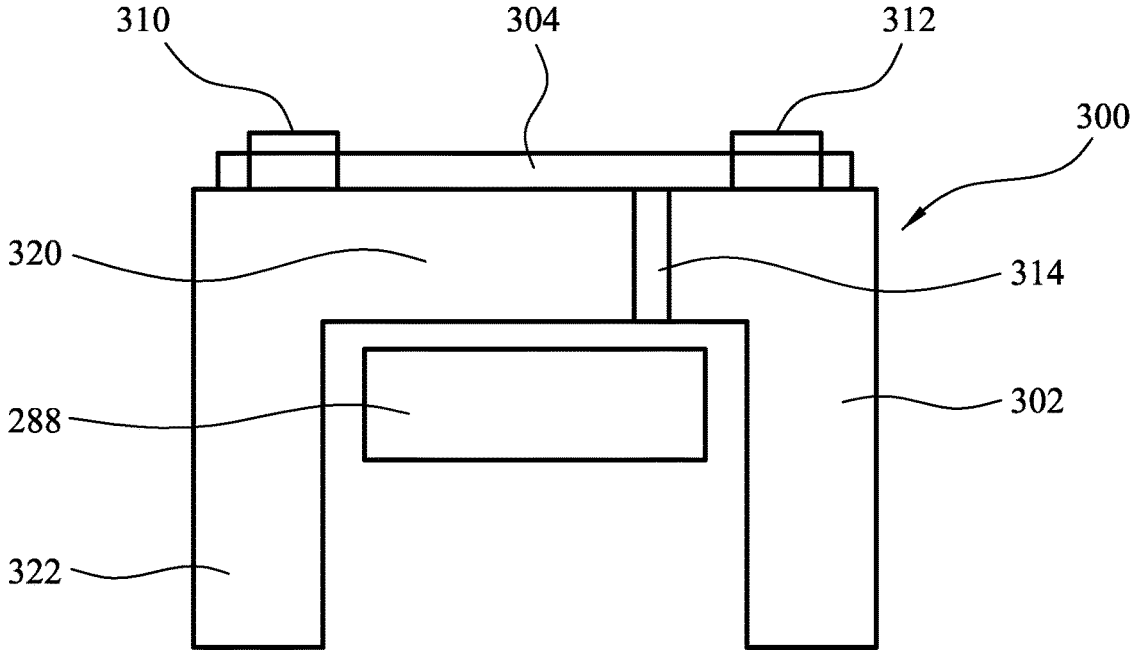
FIG. 4 shows a cross-sectional view of the first heater assembly.

FIGS. 3 and 4 show a perspective view and a cross-sectional view of the first heater assembly 300, respectively. FIG. 3 also shows the liquid aerosol-forming substrate storage component 288. The heater assembly 300 comprises the porous ceramic body 302 and the mesh heater 304. The mesh heater 304 is in contact with the porous ceramic body 302 over substantially an entirety of a face of the mesh heater 304.

The stainless steel wires 306 and the glass fibres 308 of the mesh heater 304 are interwoven. Thus, the mesh heater 304 comprises a woven hybrid mesh. The stainless steel wires 306 and the glass fibres 308 of the mesh heater 304 have diameters of around 17 microns. The thickness of the mesh heater 304 is approximately 51 microns. In FIG. 3, the apertures 309 of the mesh heater are visible. These apertures 309 each have a dimension of around 70 microns. In this example, the apertures 309 have a substantially square cross-section and the dimension is equal to the length of a side of the square cross-section.

The porous ceramic body 302 is formed entirely from alumina. The porous ceramic body 302 comprises pores with pore sizes between 2.5 microns and 40 microns. The average pore size is around 10 microns. The porosity of the porous ceramic body 302 is around 40%.

The porous ceramic body 302 comprises the first portion 320 and a projection 322. The first portion 320 has a substantially circular cross-section. This circular cross-section has a diameter of about 15 mm. The first portion 320 has a thickness of about 2 mm.

The projection 322 has a substantially annular, or ring-like, cross-section. The projection 322 is located at a periphery of the first portion 320 and extends around substantially a whole of the periphery of the first portion 320. The projection 322 extends about 10 mm substantially perpendicularly from a surface of the first portion 320. The projection 322 has a width of about 2 mm. The width of the substantially annular projection is the difference between the outer and inner radii of the annulus.

The first portion 320 of the porous ceramic body 302 comprises a channel 314 extending therethrough. The channel 314 extends substantially in a thickness direction of the first portion 320. As such, the channel 314 extends substantially perpendicularly to the plane of the mesh heater 304. The channel 314 has a diameter of about 500 microns.

Figure 5:
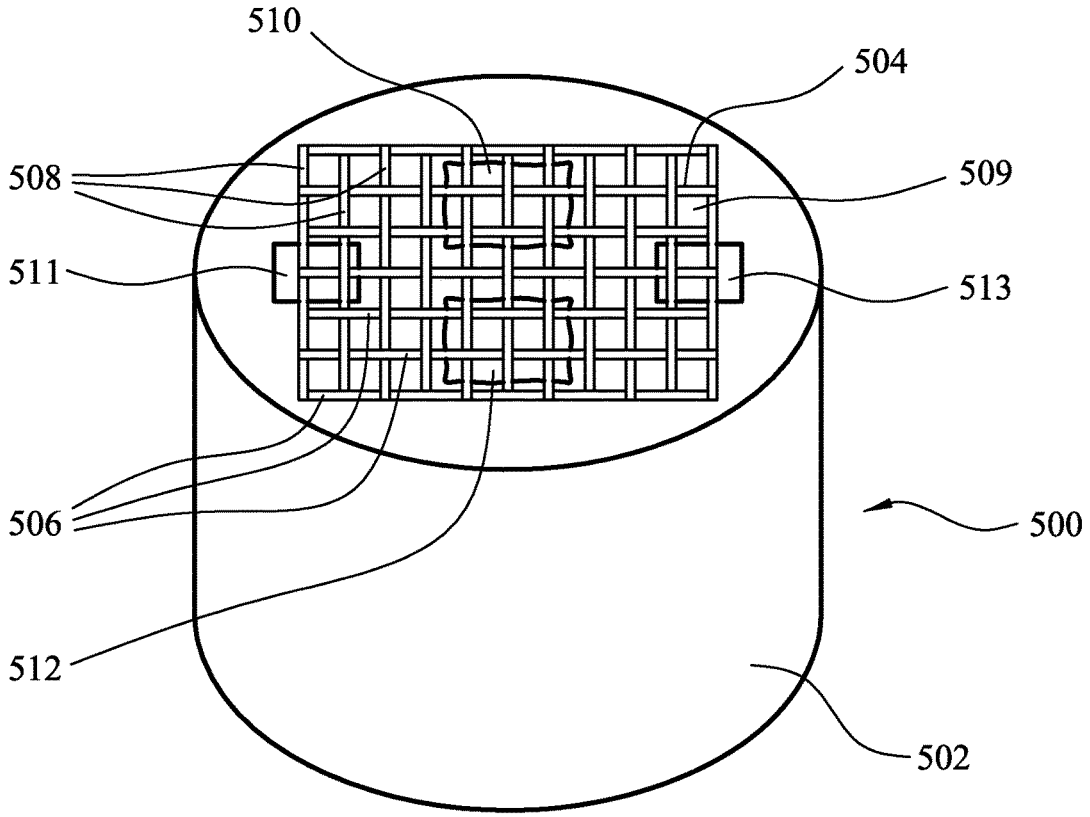
FIG. 5 shows a perspective view of a second heater assembly.
Figure 6:
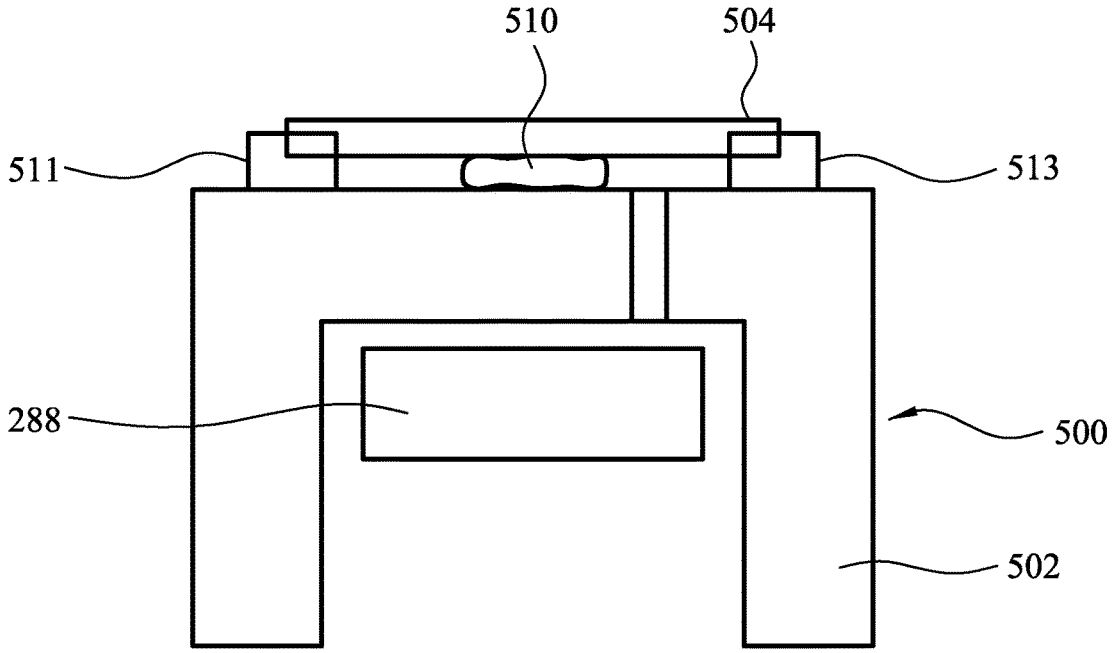
FIG. 6 shows a cross-sectional view of the second heater assembly.

FIGS. 5 and 6 show a perspective view and a cross-sectional view of a second heater assembly 500, respectively. FIG. 5 also shows the liquid aerosol-forming substrate storage component 288.

The second heater assembly 500 comprises a porous ceramic body 502, and a mesh heater 504. The porous ceramic body 502 is identical to the porous ceramic body 302 of the first heater assembly 300.

The mesh heater 504 comprises a hybrid mesh comprising stainless steel wires 506 and rayon fibres 508. The stainless steel wires 506 are interwoven with, and substantially perpendicular to, the rayon fibres 508. The mesh heater 504 is engaged with the porous ceramic body 502. Specifically, the mesh heater 504 is attached to the porous ceramic body 502. To attach the mesh heater 504 to the porous ceramic body 502, two segments of metal 510, 512 are applied to the porous ceramic body 502. In this example, the segments of metal 510, 512 are formed from tin, though silver or other suitable materials could be used. The mesh heater 504 is then positioned such that the segments of metal 510, 512 are between the porous ceramic body 502 and the mesh heater 504. The mesh heater 504 is then forced towards the porous ceramic body 502 and into the segments of metal 510, 512. The segments of metal 510, 512 adhere the porous ceramic body 502 to the mesh heater 504. In some examples, the segments of metal are coated onto the mesh heater. In some examples, heat is applied at the same time as forcing the mesh heater towards the porous ceramic body.

The second heater assembly 500 also comprises two electrodes 511, 513. These electrodes are formed from tin and are in contact with several stainless steel wires 506 and rayon fibres 508 of the mesh heater 504. When the second heater assembly 500 replaces the first heater assembly 300 in the cartridge 200 shown in FIGS. 1 and 2, the electrodes 511, 513 are each electrically connected to an electrical contact 214, 216 on the cartridge 200. This electrical connection is a wired connection and is not shown in FIG. 1 or 2. The stainless steel wires 506 are electrically connected to the electrical contacts 214, 216 through this electrical connection.

The stainless steel wires 506 and the rayon fibres 508 of the mesh heater 504 have diameters of around 17 microns. The thickness of the mesh heater 504 is approximately 51 microns. In FIG. 5, the apertures 509 of the mesh heater are visible. These apertures each have a dimension of around 70 microns. In this example, the apertures 509 have a substantially square cross-section and the dimension is a equal to the length of a side of the square cross-section.

The mesh heater 504 is in contact with the porous ceramic body 502 over substantially the entirety of the face of the mesh heater 504. In use, liquid aerosol-forming substrate held in the pores of the porous ceramic body 502 is drawn into the apertures 509 of the mesh heater 504.

In use, the second heater assembly 500 functions in much the same way as the first heater assembly 300. The second heater assembly 500 may replace the first heater assembly 300 shown in the aerosol-generating system of FIG. 1. In this case, in use, the system 100 functions in an identical manner but power is supplied to the mesh heater 504 of the second heater assembly 500 through the tin electrodes 511, 513 (rather than through the solder points 310, 312 of the first heater assembly 300).

Figure 7:
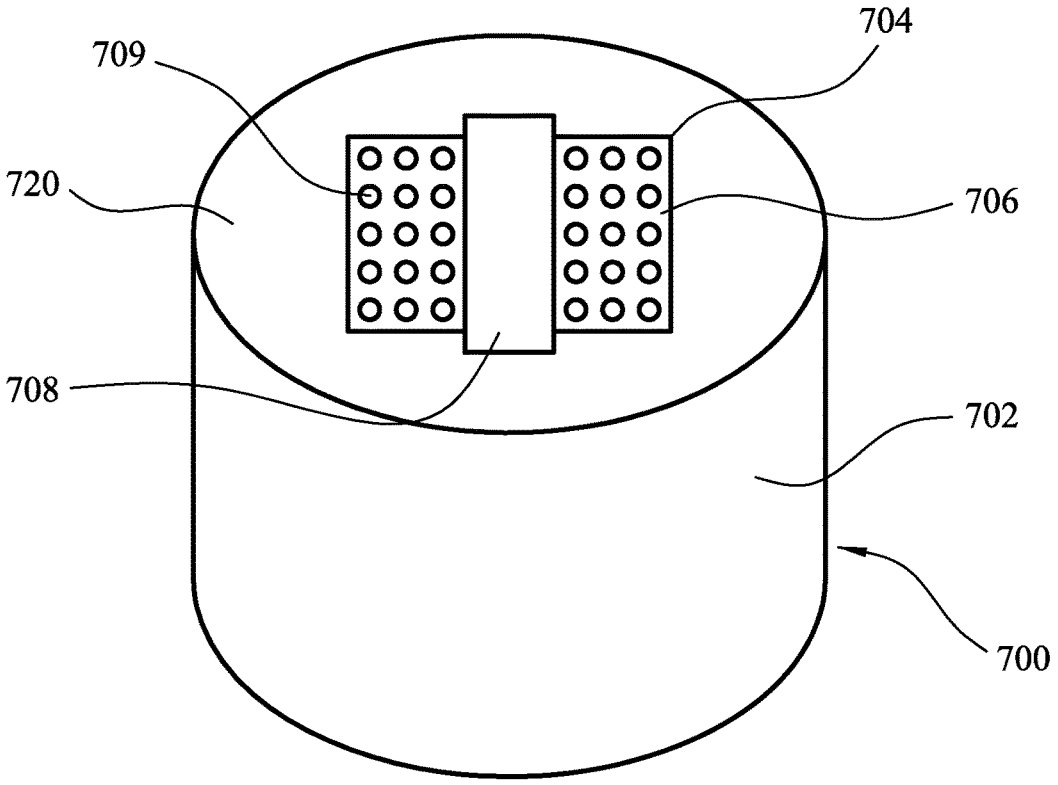
FIG. 7 shows a perspective view of a third heater assembly.
Figure 8:
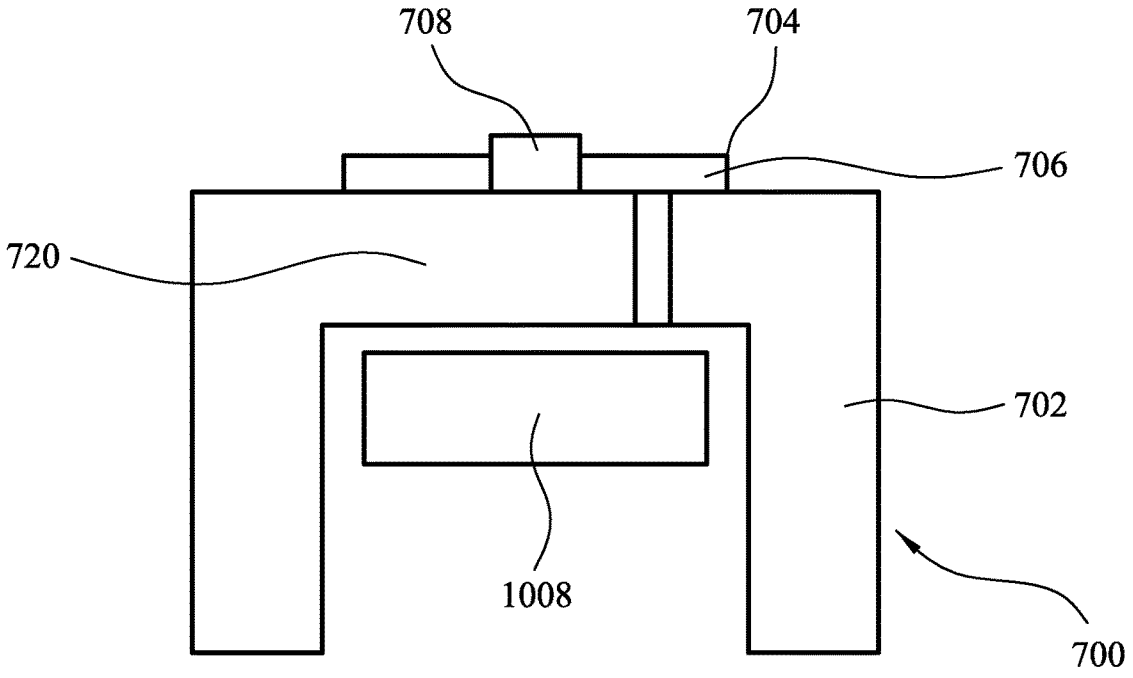
FIG. 8 shows a cross-sectional view of the third heater assembly.

FIGS. 7 and 8 show a perspective view and a cross-sectional view of a third heater assembly 700. FIG. 7 also shows a liquid aerosol-forming substrate storage component 1008.

The third heater assembly 700 comprises a porous ceramic body 702, and a mesh heater 704. The porous ceramic body 702 is identical to the porous ceramic body of the first heater assembly 302.

The mesh heater 704 comprises a stainless steel perforated plate 706. The stainless steel of the plate 706 of the mesh heater 704 is an effective susceptor material. Thus, the plate 706 acts as a susceptor.

To attach the plate 706 to the porous ceramic body 702, the plate 706 is placed in contact with the porous ceramic body 702. A covering layer 708 of a ceramic paste is then applied over the plate 706. Some of the paste is located on the plate 706 and some of the paste is located on the porous ceramic body 702. The paste applied to the porous ceramic body 702 may be applied beyond a periphery of the plate 706, or through the apertures 709 of the plate 706, or, as in this example, both. At least a portion of the plate 706 is located between the covering layer 708 and the porous ceramic body 702. The covering layer 708 is then sintered. The porous ceramic body 702 is sintered at the same time. In this example, the covering layer 708 is formed from alumina identical to the alumina of the porous ceramic body 702. The covering layer 708 adheres the porous ceramic body 702 to the plate 706.

The perforations in the plate 706 form apertures 709 with substantially circular cross-sections. In FIG. 7, the apertures 709 of the mesh heater 704 are visible. These apertures each have a dimension of around 75 microns. In this example, the apertures 709 have a substantially circular cross-section and the dimension is equal to the diameter of the circular cross-section.

The mesh heater 704 is in contact with the porous ceramic body 702 over substantially the entirety of a face of the mesh heater 704.

Figure 9:
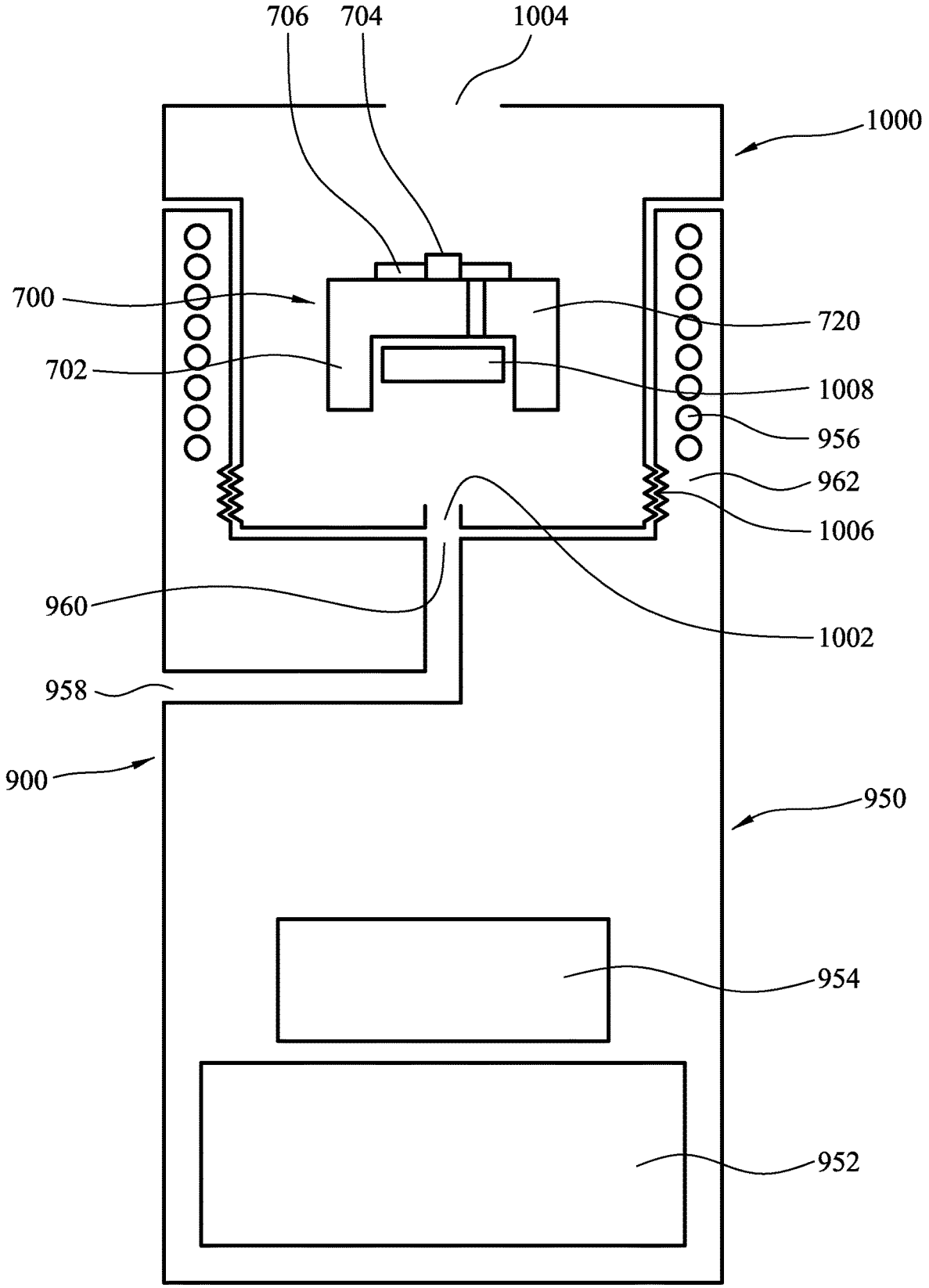
FIG. 9 shows a cross-sectional view of an aerosol-generating system incorporating a cartridge with the third heater assembly.

FIG. 9 shows a cross-sectional view of an aerosol-generating system 900. The aerosol-generating system 900 comprises an aerosol-generating device 950 and a cartridge 1000 with the third heater assembly 700. In this example, the aerosol-generating system 900 is an electrically operated smoking system.

The aerosol-generating device 950 is portable and has a size comparable to a conventional cigar or cigarette. The device 950 comprises a battery 952, such as a lithium iron phosphate battery, and a controller 954 electrically connected to the battery 952. The device 950 also comprises an induction coil 956 electrically connected to the battery 952. The device 950 also comprises an air inlet 958 and an air outlet 960 in fluid communication with the air inlet 958.

The cartridge 1000 comprises an air inlet 1002, an air outlet 1004, and the third heater assembly 700. The air inlet 1002 is in fluid communication with the air outlet 1004. The heater assembly 700 is positioned downstream of the air inlet 1002 and upstream of the air outlet 1004. When the cartridge 1000 is coupled with the aerosol-generating device 950, as shown in FIG. 9, the air outlet 960 of the device 950 is adjacent to the air inlet 1002 of the cartridge 1000. Thus, in use, when a user puffs on the air outlet 1004 of the cartridge 1000, air flows through the air inlet 958 of the device 950, then through the air outlet 960 of the device 950, then through the air inlet 1002 of the cartridge 1000, then past the heater assembly 700, then through the air outlet 1004 of the cartridge 1000.

In FIG. 9, the cartridge 1000 is coupled with the aerosol-generating device 950 by mating a screw thread 1006 of the cartridge 1000 with a corresponding screw thread 962 of the aerosol-generating device 950.

The cartridge 1000 additionally comprises a liquid aerosol-forming substrate storage component 1008 which is in fluid communication with the porous ceramic body 702. The liquid aerosol-forming substrate storage component 1008 is in contact with the first portion 720 of the porous ceramic body 702. The liquid aerosol-forming substrate storage component 1008 may be adhered to the porous ceramic body 702 with glue, or may be held in place by friction, or may be held in place by another suitable means. The liquid aerosol-forming substrate storage component 1008 in this example is a capillary material having a fibrous or spongy structure. The capillary material is formed form polyester, though any suitable material could be used. The capillary material is soaked with aerosol-forming substrate. Thus, in FIG. 9, aerosol-forming substrate is stored in the pores of the porous ceramic body 702 and in the liquid aerosol-forming substrate storage component 1008.

In use, a user puffs on the air outlet 1004 of the cartridge 1000. At the same time, the user presses a button (not shown) on the aerosol-generating device 950. Pressing this button sends a signal to the controller 954, which results in the battery 952 supplying a high frequency electrical current to the induction coil 956. This causes the induction coil to create a fluctuating electromagnetic field. The mesh heater 704 is positioned within this field. Thus, this fluctuating electromagnetic field generates eddy currents and hysteresis losses in the stainless steel plate 706, which acts as a susceptor heating element in the cartridge 1000. The plate 706 is therefore inductively heated. In other examples, an air flow sensor, or pressure sensor, is located in the device 950 and electrically connected to the controller 954. The air flow sensor, or pressure sensor, detects that a user is puffing on the air outlet 1004 of the cartridge 1000 and sends a signal to the controller 954 to provide power to the mesh heater 704. In these examples, there is therefore no need for the user to press a button to heat the mesh heater 704. The liquid aerosol-forming substrate held in the pores of the porous ceramic body 702 is drawn into apertures of the plate 706 of the mesh heater 704 by capillary action. The mesh heater 704 heats this liquid aerosol-forming substrate to vaporise the aerosol-forming substrate.

As the user puffs on the air outlet 1004 of the cartridge 1000, air is drawn into the air inlet 958 of the device 950, then through the air outlet 960 of the device 950, then through the air inlet 1002 of the cartridge 1000. This air then travels around the heater assembly 700 and towards the air outlet 1004. This flow of air entrains the vapour formed by heating of the liquid aerosol-forming substrate by the mesh heater 704. This entrained vapour then cools and condenses to form an aerosol. This aerosol is then delivered to the user via the air outlet 1004.

As liquid aerosol-forming substrate is drawn from the porous ceramic body 702 into the apertures 709 of the mesh heater 704 and vaporised, liquid aerosol-forming substrate is also drawn from the liquid aerosol-forming substrate storage component 1008 into the porous ceramic body 702. Thus, a user may be able to generate more aerosol than if the liquid aerosol-forming substrate storage component 1008 were not present.

For the purpose of the present description and the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10% of A.

The invention claimed is:

1. A cartridge for an aerosol-generating system, the cartridge comprising:

a porous ceramic body having a porosity of between 30% and 65%; and a mesh heater engaged with the porous ceramic body, the mesh heater including a plurality of apertures, each aperture having a dimension between 50 microns and 200 microns, wherein the mesh heater is a hybrid mesh heater comprising a network of wires and fibres, the fibres having a different material composition from the wires, wherein the mesh heater is planar, wherein the wires and the fibres are interwoven, and wherein the porous ceramic body is configured to supply a liquid aerosol-forming substrate to the mesh heater.

2. The cartridge according to claim 1, wherein the fibres comprise one or both of glass fibres and rayon fibres.

3. The cartridge according to claim 1, wherein the mesh heater is engaged with the porous ceramic body over substantially an entirety of a face of the mesh heater.

4. The cartridge according to claim 3, wherein the mesh heater is in contact with the porous ceramic body over substantially the entirety of the face of the mesh heater.

5. The cartridge according to claim 1, wherein the porous ceramic body comprises pores with an average pore size between 2.5 microns and 40 microns.

6. The cartridge according to claim 1, wherein the porous ceramic body comprises a first portion and a projection.

7. The cartridge according to claim 6, wherein the projection is located at a periphery of the first portion and extends around substantially a whole of the periphery of the first portion.

8. The cartridge according to claim 1, wherein the porous ceramic body comprises a channel extending therethrough, the channel having a diameter of between 300 microns and 800 microns.

9. The cartridge according to claim 1, further comprising a segment of metal located between the porous ceramic body and the mesh heater.

10. The cartridge according to claim 1, wherein the mesh heater is located between the porous ceramic body and a covering layer of a second ceramic.

11. The cartridge according to claim 10, wherein the mesh heater is attached to the porous ceramic body by the covering layer of the second ceramic.

12. An aerosol-generating system, comprising an aerosol-generating device and a cartridge according to claim 1.

13. The aerosol-generating system according to claim 12, wherein the aerosol-generating device comprises a power supply configured to supply power to the mesh heater to resistively heat the mesh heater.

14. The aerosol-generating system according to claim 12, wherein the aerosol-generating device comprises a power supply, and the cartridge or the aerosol-generating device comprise an inductor, and the power supply and the inductor are configured to inductively heat the mesh heater.

15. The cartridge according to claim 1, wherein the wires and the fibres are interwoven such that the mesh heater comprises a woven wire and fibre mesh.

16. The cartridge according to claim 1, wherein the wires lie in a single plane.

17. The cartridge according to claim 1, wherein:

the mesh heater is substantially parallel to a first surface of the porous ceramic body, the mesh heater is adjacent the first surface of the porous ceramic body, the porous ceramic body comprises a second surface substantially opposing the first surface, and in use, the liquid aerosol-forming substrate travels from the second surface to the first surface through the porous ceramic body.

18. The cartridge according to claim 1, wherein, in use, a bulk liquid aerosol-forming substrate direction of travel is substantially perpendicular to a plane of the mesh heater.

19. The cartridge according to claim 1, wherein, in use, a bulk liquid aerosol-forming substrate direction of travel is substantially parallel with a direction of an air flow through or past the mesh heater.

20. The cartridge according to claim 1, wherein:

the cartridge comprises an air inlet and an air outlet, the air inlet being in fluid communication with the air outlet, in use, there is an air flow through the air inlet, then through or past the mesh heater, then through the air outlet, and in use, a bulk liquid aerosol-forming substrate direction of travel is substantially perpendicular to a plane of the mesh heater and is substantially parallel with a direction of the air flow through or past the mesh heater.

* * * * *